US009777441B2

(12) United States Patent
Li

(10) Patent No.: US 9,777,441 B2
(45) Date of Patent: Oct. 3, 2017

(54) MODULAR ASSEMBLED ARTIFICIAL SKATING RINK

(75) Inventor: Guang Jing Li, Hong Kong (CN)

(73) Assignee: Guang Jing Li, Hong Kong (CN)

( * ) Notice: Subject to any disclaimer, the term of this patent is extended or adjusted under 35 U.S.C. 154(b) by 282 days.

(21) Appl. No.: 14/408,959

(22) PCT Filed: Jul. 25, 2012

(86) PCT No.: PCT/CN2012/079140

§ 371 (c)(1),
(2), (4) Date: Dec. 18, 2014

(87) PCT Pub. No.: WO2014/015483

PCT Pub. Date: Jan. 30, 2014

(65) Prior Publication Data

US 2015/0322631 A1 Nov. 12, 2015

(51) Int. Cl.
*F28D 7/06* (2006.01)
*E01H 4/02* (2006.01)
(Continued)

(52) U.S. Cl.
CPC ..... *E01C 13/105* (2013.01); *A63C 19/10* (2013.01); *F25C 3/02* (2013.01)

(58) Field of Classification Search
CPC .... F25C 3/02; F25C 3/00; F25B 41/00; A63C 19/10; F28D 7/06; E01C 13/105;
(Continued)

(56) References Cited

U.S. PATENT DOCUMENTS 2,411,919 A * 12/1946 Zamboni ..... E01C 13/105 62/235
2,615,308 A * 10/1952 Thorns ..... E01C 13/105 156/292

(Continued)

FOREIGN PATENT DOCUMENTS

AU 1393083 A 10/1983
CN 102012140 A * 4/2011 ..... F25C 3/02

(Continued)

*Primary Examiner* — Frantz Jules
*Assistant Examiner* — Martha Tadesse
(74) *Attorney, Agent, or Firm* — Gokalp Bayramoglu

(57) ABSTRACT

A modular assembled artificial skating rink includes a refrigerating system, a plurality of liquid-supply main pipes and air-return main pipes in the same pipe line as the liquid-supply main pipes. The liquid-supply main pipes communicate with a liquid-supply header pipe. The air-return main pipes communicate with an air-return header pipe. The liquid-supply header pipe communicates with a refrigerant-fluid outlet of the refrigerating system through at least a liquid-supply standpipe. The air-return header pipe communicates with an air-recovery end of the refrigerating system through at least an air-return standpipe. Each liquid-supply main pipe is sheathed in a corresponding air-return main pipe, forming a plurality of groups of sleeve main pipes. The artificial skating rink is divided into different modular regions. Each of the regions has sleeve manifolds and ice-making pipes. Each liquid-supply main pipe has a refrigerant-fluid control valve bank, and each air-return main pipe has an air control valve bank.

7 Claims, 4 Drawing Sheets

(51) Int. Cl.

| | |
|---|---|
| ***F28F 1/00*** | (2006.01) |
| ***E01C 13/10*** | (2006.01) |
| ***A63C 19/10*** | (2006.01) |
| ***F25C 3/02*** | (2006.01) |

(58) Field of Classification Search
CPC . E01C 13/10; F28F 9/0263; F28F 1/00; F28F 21/062; E01H 4/02
See application file for complete search history.

(56) References Cited

U.S. PATENT DOCUMENTS 2,878,651 A * 3/1959 Heinzelman ..... E01C 13/105 165/56
2,878,652 A * 3/1959 Comb ..... F25C 3/02 62/235
4,194,689 A * 3/1980 Ash ..... F25C 3/04 239/14.2
4,414,821 A * 11/1983 Jing ..... F25C 3/02 62/235
4,594,859 A 6/1986 Ohashi
5,031,409 A * 7/1991 Johnson ..... F25C 5/10 62/352
5,596,877 A * 1/1997 Morrison ..... F28D 7/08 165/10
5,970,734 A * 10/1999 Stillwell ..... F25C 3/02 285/305
6,588,441 B1 * 7/2003 Rome ..... F15B 21/005 137/1
6,672,083 B2 1/2004 Mildengren
7,191,789 B2 * 3/2007 Corbett, Jr. ..... F24D 3/1058 137/15.01
8,919,141 B2 * 12/2014 Li ..... F25C 3/02 62/235
2013/0036758 A1 * 2/2013 Li ..... F25C 3/02 62/235

FOREIGN PATENT DOCUMENTS

| | | | |
|---|---|---|---|
| CN | 102778093 | A | 11/2012 |
| CN | 202779983 | U | 3/2013 |
| DE | 2049036 | A1 | 6/1971 |
| JP | 06265248 | A * | 9/1994 |
| JP | 11132613 | A | 5/1999 |

* cited by examiner

MODULAR ASSEMBLED ARTIFICIAL SKATING RINK

TECHNICAL FIELD

The present invention refers to an artificial ice-making technique, and specifically, refers to a modular assembled artificial skating rink.

BACKGROUND

Ice sports are popular with people, and have been developed into varieties of competitive events. Conventional ice sports are held on an ice surface formed naturally under a cold weather condition, which limits the sports to be held only in a region with cold weather. As technology developed, ice sports and ice activities can be held in varieties of regions by an artificial ice-making technique.

A conventional skating rink is a one-piece ice surface on whole grounds made by an artificial ice-making device. For instance, a patent document filed on Nov. 15, 2010, whose application number is 201020608275.0, discloses an assembled-header ice making device for making an artificial skating rink. An ice-making unit is configured for making a refrigerant fluid with a lower temperature. The refrigerant fluid is transferred to all parts of the skating rink through a liquid supplying header pipe and an ice-making pipe, to exchange heat with the ice surface. The refrigerant fluid absorbs heat and is vaporized into a gas which flows back to the ice-making unit by an air-return pipe and an air-return header pipe to be used for a next circulation of making ice.

Although the ice-making device can make the ice surface with a reliable quality quickly, it can only make the one-piece ice surface, and cannot specifically make ice on necessary regions. For example, for a long-track speed-skating sport event, what people need for speed skating is only an annular ice surface with a perimeter of 400 meters. For such circumstances, it is obviously wasteful to make the whole ice surface, because the ice surface on an inner region of the annular skating track is not necessarily needed.

SUMMARY OF THE INVENTION

To overcome the defects described above, the present invention provides a modular assembled artificial skating rink which can separately make ice on different regions. The different regions on the same skating rink are assembled to meet all kinds of requirements to avoid wasting energy.

Some embodiments of the present invention refer to:

A modular assembled artificial skating rink, comprising:

a refrigerating system, a plurality of liquid-supply main pipes and air-return main pipes in the same pipe line as the liquid-supply main pipes; wherein the liquid-supply main pipes communicate with a liquid-supply header pipe; the air-return main pipes communicate with an air-return header pipe; the liquid-supply header pipe communicates with a refrigerant-fluid outlet of the refrigerating system through at least a liquid-supply standpipe; the air-return header pipe communicates with an air-recovery end of the refrigerating system through at least an air-return standpipe; each liquid-supply main pipe is sheathed in a corresponding air-return main pipe, forming a plurality of groups of sleeve main pipes; the artificial skating rink is divided into different modular regions; each of the regions has sleeve manifolds and ice-making pipes; the sleeve manifolds include a liquid-supply manifold positioned internally and an air-return manifold positioned outside the liquid-supply manifold; the ice-making pipes communicate between the liquid-supply manifold and the air-return manifold; groups of the sleeve main pipes extend to all the modular regions; the liquid-supply main pipes communicate with the liquid-supply manifolds; the air-return main pipes communicate with the air-supply manifolds; each liquid-supply main pipe has a refrigerant-fluid control valve bank; and each air-return main pipe has an air control valve bank.

The liquid-supply main pipes are arranged evenly on both sides of the liquid-supply header pipe, or arranged evenly on one side of the liquid-supply header pipe; and the air-return main pipe are arranged evenly on both sides of the air-return header pipe, or arranged evenly on one side of air-return header pipe.

The liquid-supply main pipe of each group of the sleeve main pipes has a U-type portion extending outside the air-return main pipe of the said group of the sleeve main pipes; the refrigerant-fluid control valve bank includes a first electromagnetic valve mounted in the U-type portion, and two first stop valves; the first electromagnetic valve is positioned between the two first stop valves; the air control valve bank includes a second electromagnetic valve and two second stop valves, the second electromagnetic valve is positioned between the two second stop valves; and each first electromagnetic valve and each second electromagnetic are automatically control to open or close by a controller in an ice-making machine room.

The air-return main pipes, the air-return manifolds, the air-return standpipes, the air-return header pipe, the refrigerant-fluid control valve banks, the air control valve banks and the U-type portions of the liquid-supply main pipes extending outside the air-return main pipes, separately have one or more insulating layers covering outward.

The liquid-supply header pipe is sheathed in the air-return header pipe; both ends of the air-return header pipe and the liquid-supply header pipe are sealed with sealing plates; and the liquid-supply standpipe is sheathed in the air-return standpipe.

The rink includes three air-return standpipes and three liquid-supply pipes; each liquid-supply standpipe is sheathed in a corresponding air-return standpipe, constituting three sleeve standpipes which are evenly spaced along a length direction of the air-return header pipe; and the middle sleeve standpipe is positioned at the middle of the air-return header pipe.

The refrigerating system is a cabinet unitary ice-making unit or ice-making device.

Beneficial effects of the present invention are as follows:

Compared with the prior art, the present invention can separately make ice on the necessary regions according to different usage requirements of the rink, and makes an ice surface with a necessary shape as required. In the process of making ice, the rink only makes ice on the necessary regions separately, and thus reduces energy consumption substantially.

Figure 1:
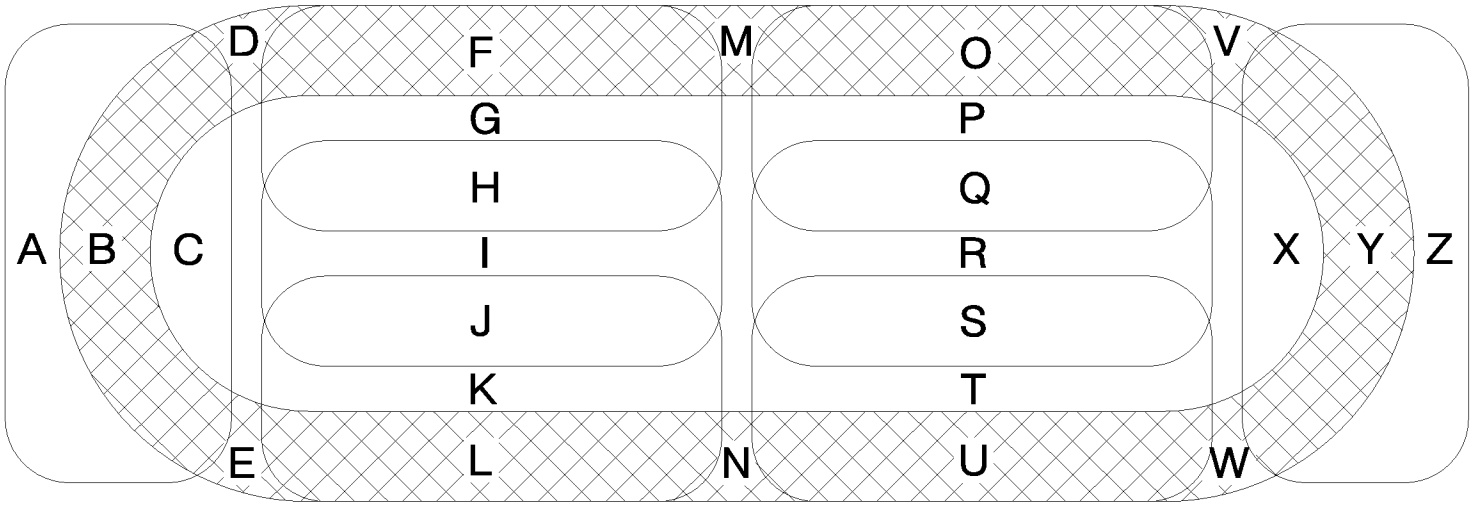
FIG. 1 is a schematic diagram of a modular assembled artificial skating rink.

Wherein:

refrigerating system 1; air-return standpipe 21; liquid-supply standpipe 22; air-return header pipe 31; liquid-supply header pipe 32; sealing plate 33; air-return main pipe 41; electromagnetic valve 411; stop valve 412; stop valve 413; liquid-supply main pipe 42; electromagnetic valve 421; stop valve 422; and stop valve 423.

DETAILED DESCRIPTION OF THE PREFERRED EMBODIMENTS

Figure 2:
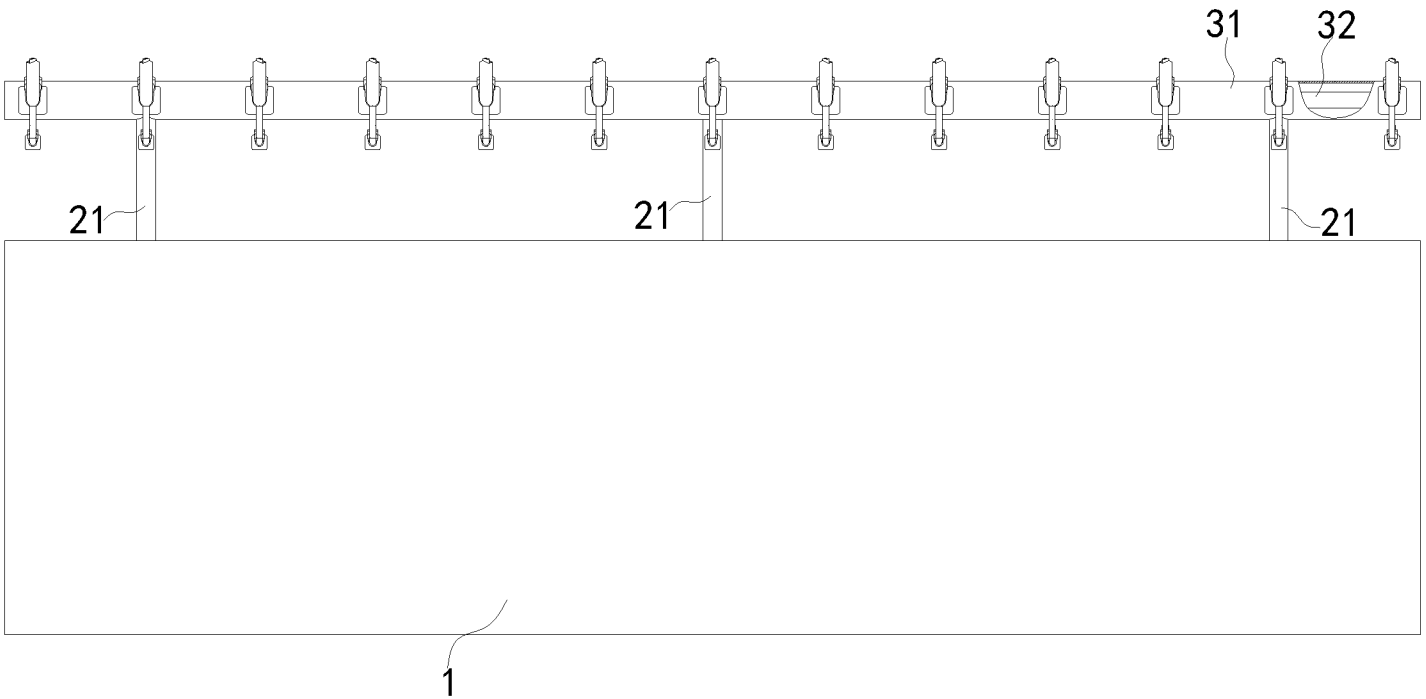
FIG. 2 is a schematic diagram of an ice-making device in an ice-making machine room of the artificial skating rink of FIG. 1.
Figure 3:
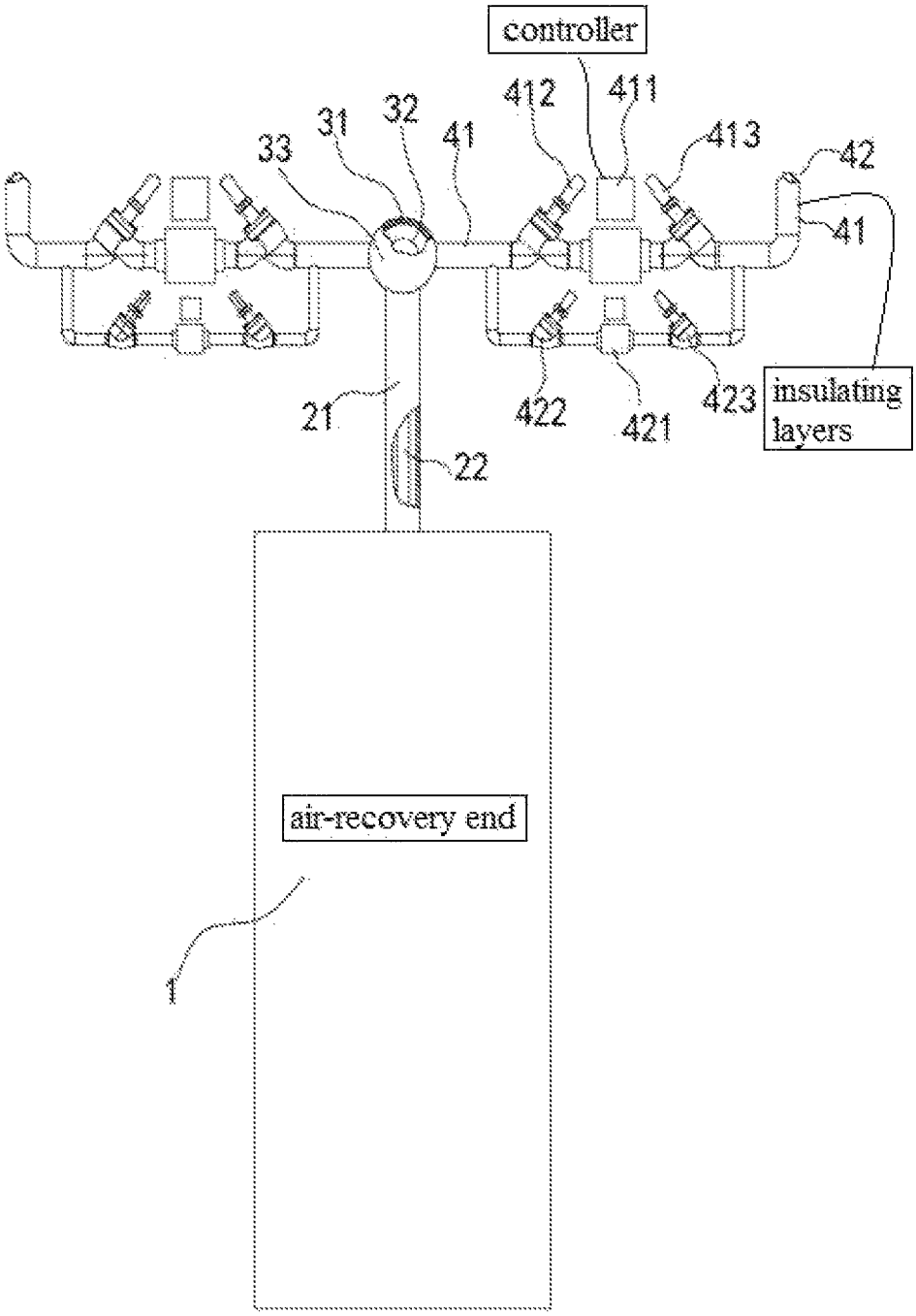
FIG. 3 is a side view of the ice-making device of FIG. 2.
Figure 4:
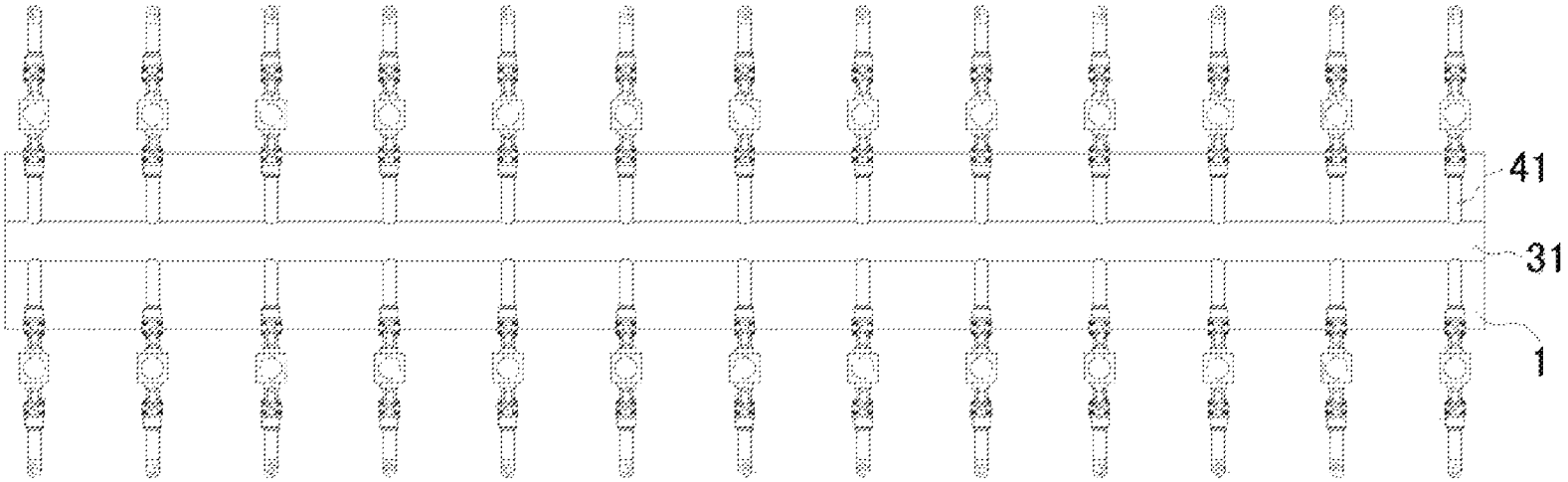
FIG. 4 is a plan view of the ice-making device of FIG. 2.

Referring to the FIG. 1 to FIG. 4, a modular assembled artificial skating rink includes main ice-making devices mounted in an ice-making machine room under an ice surface of the skating rink, and further includes a refrigerating system 1, a plurality of liquid-supply main pipes 42 and air-return main pipes 41 whose number is as the same as the liquid-supply main pipe 42. Each liquid-supply main pipe 42 is sheathed in a corresponding air-return main pipe 41, forming a plurality of groups of sleeve main pipes. The liquid-supply main pipes 42 communicate with a liquid-supply header pipe 32. The air-return main pipes 41 communicate with an air-return header pipe 31. The liquid-supply header pipe 32 is sheathed in the air-return header pipe 31. The air-return header pipe 31 extends along the same length direction as the liquid-supply header pipe 32. Both ends of the air-return header pipe 31 and the liquid-supply header pipe 32 are sealed with sealing plates 33. The refrigerating system 1 is a cabinet unitary ice-making unit or ice-making device mounted in the ice-making machine room under the ice surface of the skating rink. The length direction of the liquid-supply header pipe 32 and the air-return header pipe 31 is as the same as the refrigerating system 1. The air-return header pipe 31 communicates with an air-recovery end of the refrigerating system 1 through at least an air-return standpipe 21. The liquid-supply header pipe 32 communicates with a refrigerant-fluid outlet of the refrigerating system 1 through at least a liquid-supply standpipe 22. The liquid-supply standpipe 22 is sheathed in the air-return standpipe 21. The air-return main pipes 41, air-return manifolds, the air-return standpipes 21, the air-return header pipe 31, refrigerant-fluid control valve banks, air control valve banks and U-type portions of the liquid-supply main pipes 42 extending outside the air-return main pipes 41, separately have one or two insulating layers covering outward, to avoid exchanging heat with the outside environment and to reduce energy consumption.

The liquid-supply main pipes 42 are arranged evenly on both sides of the liquid-supply header pipe 32, or arranged evenly on one side of the liquid-supply header pipe 32. The air-return main pipe 41 are arranged evenly on both sides of the air-return header pipe 31, or arranged evenly on one side of air-return header pipe 31.

Each liquid-supply main pipe 42 has the refrigerant-fluid control valve bank, and each air-return main pipe 41 has the air control valve bank. The air control valve bank includes an electromagnetic valve 411, a stop valve 412 and a stop valve 413. The electromagnetic valve 411, the stop valve 412 and the stop valve 413 are mounted on the air-return main pipe 41. The electromagnetic valve 411 is positioned between the stop valve 412 and the stop valve 413. The U-type portion of the liquid supply main pipe 42 extending outside the air-return main pipe 41 is configured for installing the refrigerant-fluid control valve bank. The refrigerant-fluid control valve bank includes an electromagnetic valve 421, a stop valve 422 and a stop valve 423. The electromagnetic valve 421, the stop valve 422 and the stop valve 423 are mounted on a horizontal extension part of a bottom of the U-type portion. The electromagnetic valve 421 is positioned between the stop valve 422 and the stop valve 423. The electromagnetic valves 411 and electromagnetic valves 421 are automatically control to open and close by a controller in the ice-making machine room. In other words, when a staff needs to open one of the sleeve main pipes, he/she can conduct an operation on an operation panel of the intelligent controller, namely the controller mounted in the ice-making machine room. In normal use, the stop valve 412 and the stop valve 413 are normally open. If the electromagnetic valve 411 needs to be maintained when broken down, the stop valve 412 and the stop valve 413 should be closed manually. In the same way, in normal use, the stop valve 422 and the stop valve 423 are normally open. If the electromagnetic valve 421 needs to be maintained when broken down, the stop valve 422 and the stop valve 423 should be closed manually.

In order that the refrigerant fluid can be uniformly transferred from the refrigerating system 1 to the liquid-supply header pipe 32, and the air can flow back from the air-return header pipe 31 to the refrigerating system 1, three air-return standpipes 21 and three liquid-supply standpipes 22 are set. Each liquid-supply standpipe 22 is sheathed in a corresponding air-return standpipe 21, constituting three sleeve standpipes which are evenly spaced along a length direction of the air-return header pipe 31. The middle sleeve standpipe is positioned at the middle of the air-return header pipe 31. Therefore, the refrigerant fluid outputted from the refrigerating system 1 can be transferred to the liquid-supply header pipe 32 through three liquid-supply standpipes 22, and promptly transferred to the nearer liquid-supply main pipes 42. The air in the air-return main pipes 41 can promptly flow back to the refrigerating system 1 through the nearer air-return standpipes 21.

The ground of the rink is divided into a plurality of regions with different shapes. As show in FIG. 1, the ground is divided into twenty-six regions A to Z. Each of the regions has sleeve manifolds and ice-making pipes. The sleeve manifolds include a liquid-supply manifold positioned internally and an air-return manifold positioned outside the liquid-supply manifold. The ice-making pipes communicate between the liquid-supply manifold and the air-return manifold. Groups of the sleeve main pipes extend to all the modular regions. The liquid-supply main pipes 42 communicate with the liquid-supply manifolds in all the regions, and the air-return main pipes 41 communicate with the air-supply manifolds in all the regions. Thirteen air-return main pipes 41 are mounted on each side of the air-return header pipe 31, or twenty-six air-return main pipes 41 are mounted on one side of the air-return header pipe 31. Thirteen liquid-supply main pipes 42 are mounted on each side of the liquid-supply header pipe 32, or twenty-six liquid-supply main pipes 42 are mounted on one side of the liquid-supply header pipe 32. Each group of the sleeve main pipes extends right underneath a central portion of the twenty-six regions. The refrigerant fluid outputted from the refrigerating system 1 is transferred to ice-making manifolds and the ice-making pipes in corresponding regions, exchanges heat with the ice surface of the corresponding regions, and turns into a gas which flows back to the refrigerating system 1. Thus a refrigeration cycle is completed. In the process of refrigeration, the staff can control operative states of the electromagnetic valves 411 and the electromagnetic valves 421 via the panel of the controller in the ice-making machine room. Specifically, the operative states of the electromagnetic valve 411 and electromagnetic valve 421 are synchronous. According to a necessary shape of the ice surface, the operative states of the electromagnetic valves 411 and the electromagnetic valves 421 in different sleeve main pipes can be controlled to make the ice surface as required. For instance, in making a 400 meters annular speed skating runway, the electromagnetic valves 411 and the electromagnetic valves 421 in the sleeve main pipes underneath the regions B, D, F, M, O, V, Y, W, U, N, L and E are open, and ones underneath other regions are closed. Thus ice surfaces on regions B, D, F, M, O, V, Y, W, U, N, L and E constitute the 400 meters annular speed skating runway. Certainly, the staff can simply control the operative states of the electromagnetic valves 411 and the electromagnetic valves 421 in the sleeve main pipes via the operation panel of the controller in the ice-making machine room to make various shapes of ice surfaces.

The rink in the present invention can separately make ice on the necessary regions to make an ice surface with a necessary shape, and thus reduces energy consumption substantially, and makes flexible and multifunctional use of a structure.

Various modifications could be made to the embodiments by those of ordinary skill in the art without departing from the true spirit and scope of the disclosure. And those modified embodiments are covered by the claims of the disclosure.

What is claimed is:

1. A modular assembled artificial skating rink, comprising:

a refrigerating system;

a plurality of liquid-supply main pipes; and air-return main pipes in the same pipe line as the liquid-supply main pipes;

wherein the liquid-supply main pipes communicate with a liquid-supply header pipe;

the air-return main pipes communicate with an air-return header pipe;

the liquid-supply header pipe communicates with a refrigerant-fluid outlet of the refrigerating system through at least a liquid-supply standpipe;

the air-return header pipe communicates with an air-recovery end of the refrigerating system through at least an air-return standpipe;

each liquid-supply main pipe is sheathed in a corresponding air-return main pipe, forming a plurality of groups of sleeve main pipes;

the artificial skating rink is divided into different modular regions;

each of the regions has sleeve manifolds and ice-making pipes;

the sleeve manifolds include a liquid-supply manifold positioned internally and an air-return manifold positioned outside the liquid-supply manifold;

the ice-making pipes communicate between the liquid-supply manifold and the air-return manifold;

groups of the sleeve main pipes extend to all the modular regions;

the liquid-supply main pipes communicate with the liquid-supply manifolds;

the air-return main pipes communicate with the air-supply manifolds;

each liquid-supply main pipe has a refrigerant-fluid control valve bank;

and each air-return main pipe has an air control valve bank;

the liquid-supply main pipe of each group of the sleeve main pipes has a U-type portion extending outside the air-return main pipe of the said group of the sleeve main pipes;

the refrigerant-fluid control valve bank includes a first electromagnetic valve mounted in the U-type portion and two first stop valves mounted in the same U-type portion;

the first electromagnetic valve is positioned between the two first stop valves;

the air control valve bank includes a second electromagnetic valve and two second stop valves; and the second electromagnetic valve is positioned between the two second stop valves.

2. The modular assembled artificial skating rink of claim 1, wherein the liquid-supply main pipes are arranged evenly on both sides of the liquid-supply header pipe, or arranged evenly on one side of the liquid-supply header pipe; and the air-return main pipe are arranged evenly on both sides of the air-return header pipe, or arranged evenly on one side of air-return header pipe.

3. The modular assembled artificial skating rink of claim 1, wherein each first electromagnetic valve and each second electromagnetic are automatically control to open or close by a controller in an ice-making machine room.

4. The modular assembled artificial skating rink of claim 1, wherein the air-return main pipes, the air-return manifolds, the air-return standpipes, the air-return header pipe, the refrigerant-fluid control valve banks, the air control valve banks and the U-type portions of the liquid-supply main pipes extending outside the air-return main pipes, separately have one or more insulating layers covering outward.

5. The modular assembled artificial skating rink of claim 1, wherein the liquid-supply header pipe is sheathed in the air-return header pipe; both ends of the air-return header pipe and the liquid-supply header pipe are sealed with sealing plates; and the liquid-supply standpipe is sheathed in the air-return standpipe.

6. The modular assembled artificial skating rink of claim 5, wherein the rink includes three air-return standpipes and three liquid-supply pipes; each liquid-supply standpipe is sheathed in a corresponding air-return standpipe, constituting three sleeve standpipes which are evenly spaced along a length direction of the air-return header pipe; and the middle sleeve standpipe is positioned at the middle of the air-return header pipe.

7. The modular assembled artificial skating rink of claim 1, wherein the refrigerating system is a cabinet unitary ice-making unit or ice-making device.

* * * * *